US010871336B1

(12) United States Patent
Johnston

(10) Patent No.: US 10,871,336 B1
(45) Date of Patent: Dec. 22, 2020

(54) REVOLVING BATTERY MACHINE GUN WITH ELECTRONICALLY CONTROLLED DRIVE MOTORS

(71) Applicant: Travis Johnston, Charles City, VA (US)

(72) Inventor: Travis Johnston, Charles City, VA (US)

( * ) Notice: Subject to any disclaimer, the term of this patent is extended or adjusted under 35 U.S.C. 154(b) by 0 days.

(21) Appl. No.: 16/667,171

(22) Filed: Oct. 29, 2019

Related U.S. Application Data

(60) Provisional application No. 62/752,452, filed on Oct. 30, 2018.

(51) Int. Cl.
*F41A 9/36* (2006.01)
*F41A 19/68* (2006.01)

(52) U.S. Cl.
CPC ..... *F41A 9/36* (2013.01); *F41A 19/68* (2013.01)

(58) Field of Classification Search
CPC ..... F41A 7/02; F41A 7/06; F41A 7/08; F41A 7/10; F41A 9/36; F41A 19/65; F41A 19/68
USPC ..... 89/9, 11, 12, 13.05
See application file for complete search history.

(56) References Cited

U.S. PATENT DOCUMENTS

| | | | | |
|---|---|---|---|---|
| 125,563 | A | 4/1872 | Gatling | |
| 2,482,290 | A | 9/1949 | Roters | |
| 2,872,847 | A | 2/1959 | Otto | |
| 3,135,905 | A | 6/1964 | Malcho | |
| 3,380,341 | A | 4/1968 | Chiabrandy | |
| 3,568,563 | A | 3/1971 | Folson | |
| 3,611,871 | A | 10/1971 | Kirpatrick et al. | |
| 3,706,259 | A | 12/1972 | Ashley et al. | |
| 3,738,221 | A | 6/1973 | Tan et al. | |
| 4,046,056 | A | 9/1977 | Carrie | |
| 4,299,158 | A | 11/1981 | Aloi et al. | |
| 4,748,891 | A | 6/1988 | Meier | |
| 4,777,864 | A | 10/1988 | Siech et al. | |
| 4,924,752 | A | 5/1990 | Tassie et al. | |
| 4,924,753 | A | 5/1990 | Tassie et al. | |
| 5,042,360 | A | 8/1991 | Burmeister et al. | |
| 5,329,840 | A | 7/1994 | Corney | |
| 5,675,105 | A | 10/1997 | Simon et al. | |
| 6,889,680 | B2 | 5/2005 | Christopher et al. | |
| 8,136,515 | B2 * | 3/2012 | Galinson | F41B 11/54 124/51.1 |
| 8,656,820 | B1 * | 2/2014 | Kertis, Jr. | F41A 7/10 89/27.3 |
| 10,557,683 | B1 * | 2/2020 | Staffetti | F41A 19/64 |
| 2003/0167909 | A1 | 9/2003 | Matter | |
| 2008/0092727 | A1 | 4/2008 | Glascock | |
| 2012/0152103 | A1 | 6/2012 | Testa et al. | |

(Continued)

FOREIGN PATENT DOCUMENTS

| | | | | |
|---|---|---|---|---|
| DE | 2937825 | A1 * | 4/1980 | F41F 1/10 |

*Primary Examiner* — Stephen Johnson
(74) *Attorney, Agent, or Firm* — Dunlap Bennett & Ludwig, PLLC; Brendan E. Squire

(57) ABSTRACT

A Gatling type machine gun system whose rotational operation of subsystems is accomplished by way of a plurality of electronically controlled motors. The Gatling type gun system includes a core gun, a feeder subsystem, and a transfer subsystem each of which must operate at particular instance and speed to accomplish the proper operation of the gun system. Control of the gun and subsystems is provided by electronically controlled motors.

20 Claims, 11 Drawing Sheets

(56) References Cited

U.S. PATENT DOCUMENTS

| | | | |
|---|---|---|---|
| 2017/0205167 | A1 | 7/2017 | Abbott |
| 2018/0231344 | A1 | 8/2018 | Schneider |

* cited by examiner

REVOLVING BATTERY MACHINE GUN WITH ELECTRONICALLY CONTROLLED DRIVE MOTORS

CROSS-REFERENCE TO RELATED APPLICATION

This application claims the benefit of priority of U.S. provisional application No. 62/752,452, filed Oct. 30, 2018, the contents of which are herein incorporated by reference.

BACKGROUND OF THE INVENTION

The present invention relates to a revolving battery, rotary, or Gatling type machine guns, and more particularly to a rotary type machine gun that uses multiple independently controlled electronic motors for operation.

High rate of fire revolving battery machine guns, also known as rotary or Gatling type machine guns, are well known. In U.S. Pat. No. 125,563, issued Apr. 9, 1872 to R. J. Gatling, there is shown the classic modern revolving battery gun. A stationary housing encloses and supports a rotor assembly which has a plurality of gun barrels and a like plurality of gun bolts. Each bolt has its own firing pin and mainspring. As the rotor turns, each bolt is traversed longitudinally by a stationary elliptical cam track in the housing. As the bolt is traversed forwardly, its firing pin is captured to the rear by a stationary cam track in the housing, compressing its mainspring until the bolt and the barrel reach the firing position, at which position the stationary cam track releases or sears the firing pin.

Components and operation of more modern Gatling type machine guns are described and shown by R. E. Chiabrandy in U.S. Pat. No. 3,380,341, issued Apr. 30, 1968; R. G. Kirkpatrick et al in U.S. Pat. No. 3,611,871, issued Oct. 12, 1971; and R. M. Tan et al in U.S. Pat. No. 3,738,221, issued Jun. 12, 1973. H. McC. Otto in U.S. Pat. No. 2,872,847, issued Feb. 10, 1959.

Other examples of rotary type machine gun systems include but are not limited to M134D minigun and GAU-19/B. These rotary machine gun systems comprise a core gun, feeder, and transfer subsystems. The core gun includes a stationary housing, a rotor assembly, a revolving cluster of barrels, a respective bolt assembly, where the rounds of primed ammunition are chambered through rotary motion and fired, either via percussion, or an electrical signal to ignite the primer. The feeder is where the rounds of ammunition are received from the storage container or magazine, and they are prepared for handoff to the gun. The transfer receives the rounds of ammunition from the feeder and provides them to the gun at the matched time and speed for proper handoff.

Separate operation of these gun systems allows the operation of a safety function attribute known as a clearing cycle. At the release of the trigger or firing signal, the clearing cycle arrests the feed of ammunition to the gun yet allows the ammunition that is within the core gun to be removed from the chamber of each barrel. This helps to reduce the potential for and un-intended firing of ammunition.

Gatling type machine guns, such as the M134D minigun and the GAU-19/B, are driven by a single rotational power input of an electric motor. They utilize a combination of mechanical power transmission methods from the single motor to accomplish the rotation required (for example: gears, drive shafts, clutches). The mechanical power transmission between the subsystems when engaged and disengaged must remain synchronized in order to maintain the proper handoff of the ammunition between subsystems. These types of designs for rotary type machine guns provide several disadvantages: a high part count of precise and complex components, heavy weight, and large packaging size. Additionally, in the event of a gun stoppage the result is often damaging to internal components and time consuming to correct due to the high amount of inertial energy that is absorbed at the moment the gun rotation becomes impeded.

As can be seen, there is a need for an improved drive and control system for revolving battery machine guns.

SUMMARY OF THE INVENTION

In one aspect of the present invention, a revolving battery machine gun, is disclosed. The revolving battery machine gun has a core gun assembly including a barrel cluster with a plurality of radially disposed gun barrels rotationally carried by a gun rotor. A bolt assembly is configured to chamber and extract an ammunition round into each of the plurality of radially disposed gun barrels. A gun drive motor is coupled for axial rotation of the gun rotor.

A feeder assembly has a feed sprocket that is configured to individually draw a plurality of ammunition rounds from a source of ammunition. A feeder drive motor is coupled for axial rotation of the feed sprocket.

A transfer assembly has a transfer sprocket that configured to transfer each of the plurality of ammunition rounds between the feeder assembly and the bolt assembly. A transfer drive motor coupled for axial rotation of the transfer sprocket.

An electronic controller provides a discrete motion command signal to each of the gun drive motor, the feeder drive motor, and the transfer drive motor. The discrete motion command signal has a trajectory profile corresponding to a desired rate of fire.

In some embodiments, the revolving battery machine gun also includes a programmable micro controller that is in communication with a gun motor control drive. The gun motor control drive is operatively coupled to deliver a gun drive motion command signal to the gun drive motor.

In some embodiments, a feeder motor control drive is in communication with the programmable micro controller and is operatively coupled to deliver a feeder motion command signal to the feeder drive motor.

In some embodiments, a transfer motor control drive is in communication with the programmable micro controller and is operatively coupled to deliver a transfer motion command signal to the transfer drive motor.

In preferred embodiments, the transfer motion command signal has a trajectory profile that alternates between a lower threshold value and an upper threshold value. The trajectory profile includes a steady velocity shelf at the upper threshold value at a transfer point for the transfer of an ammunition round between the transfer sprocket and the bolt assembly.

In yet other embodiments, the gun drive motion command signal includes a steady acceleration to reach a specified rotation rate of the gun drive motor. The feeder motion command signal may also include a steady acceleration to reach a specified rotation rate of the feeder drive motor.

In other aspects of the invention, an electronic drive system for a revolving battery machine gun is disclosed. The electronic drive system includes an electronic gun motor coupled for axial rotation of a rotor of a gun barrel assembly. An electronic feeder motor is coupled for axial rotation of a feed sprocket configured to draw a plurality of ammunition rounds from a source of ammunition. An electronic transfer motor is coupled for axial rotation of a transfer sprocket. The transfer sprocket is configured to transfer each of the plurality of ammunition rounds between a feeder assembly and a breach assembly. An electronic controller provides a discrete motion command signal to each of the electronic gun motor, the electronic feeder motor, and the electronic transfer motor, wherein each discrete motion command signal has a trajectory profile corresponding to a desired rate of fire.

In some embodiments, an output shaft of the electronic gun motor is directly coupled to the rotor. The output shaft of the electronic gun motor may be coaxially aligned with an axis of rotation of the rotor.

In other embodiments, an output shaft of the electronic feeder motor is directly coupled to the transfer sprocket. The output shaft of the electronic feeder motor may becoaxially aligned with an axis of rotation of the feeder sprocket.

In yet other embodiments, a first pulley is coupled to an output shaft of the electronic transfer drive motor. A second pulley is coupled for axial rotation of the transfer sprocket. A drive belt may then be entrained about the first pulley and the second pulley. The output shaft of the electronic transfer motor is coaxially aligned with a rotational axis of the first pulley.

In some embodiments, the electronic controller may include a gun motor control drive interposed between a programmable micro controller and the electronic gun motor. A feeder motor control drive interposed between the programmable micro controller and the electronic feeder motor. A transfer motor control drive is interposed between the programmable micro controller and the electronic transfer motor.

In some embodiments, a gun motor position feedback sensor is in communication with the gun motor control drive. The gun motor position feedback sensor is configured to detect an angular displacement of the electronic gun drive motor. In other embodiments, a feeder motor position feedback sensor is in communication with the feeder motor control drive. The feeder motor position feedback sensor is configured to detect an angular displacement of the electronic feeder drive motor. A transfer motor position feedback sensor is communication with the transfer motor control drive. The transfer motor position feedback sensor is configured to detect an angular displacement of the electronic transfer motor.

In other embodiments, the programmable micro controller synchronizes propagation of the discrete motion command signal to each of the gun motor control drive, the feeder motor control drive, and the transfer motor control drive.

In other embodiments, the programmable micro controller slaves propagation of a gun trajectory profile and a transfer trajectory profile to a feeder trajectory profile.

In yet other aspects of the invention, an electronic transfer assembly for a revolving battery machine gun is disclosed. The electronic transfer assembly includes a transfer sprocket rotatable to receive an ammunition round from a feeder sprocket of a feeder assembly to a bolt assembly of the revolving battery machine gun. An electronic transfer motor is coupled to rotate the transfer sprocket. A programmable micro controller is programmed to send a motion command signal to the electronic transfer motor. The motion command signal has a transfer trajectory profile that alternates between a lower threshold value and an upper threshold value. The lower threshold value corresponds to an ammunition round transition between the feeder sprocket and the transfer sprocket and the upper threshold value corresponds to an ammunition round transition between the transfer sprocket and the bolt assembly.

In other embodiments, the transfer trajectory profile also includes a steady velocity shelf defined at the upper threshold value at a transfer of the ammunition round between the transfer sprocket and the bolt assembly.

These and other features, aspects and advantages of the present invention will become better understood with reference to the following drawings, description and claims.

DETAILED DESCRIPTION OF THE INVENTION

Figure 1:
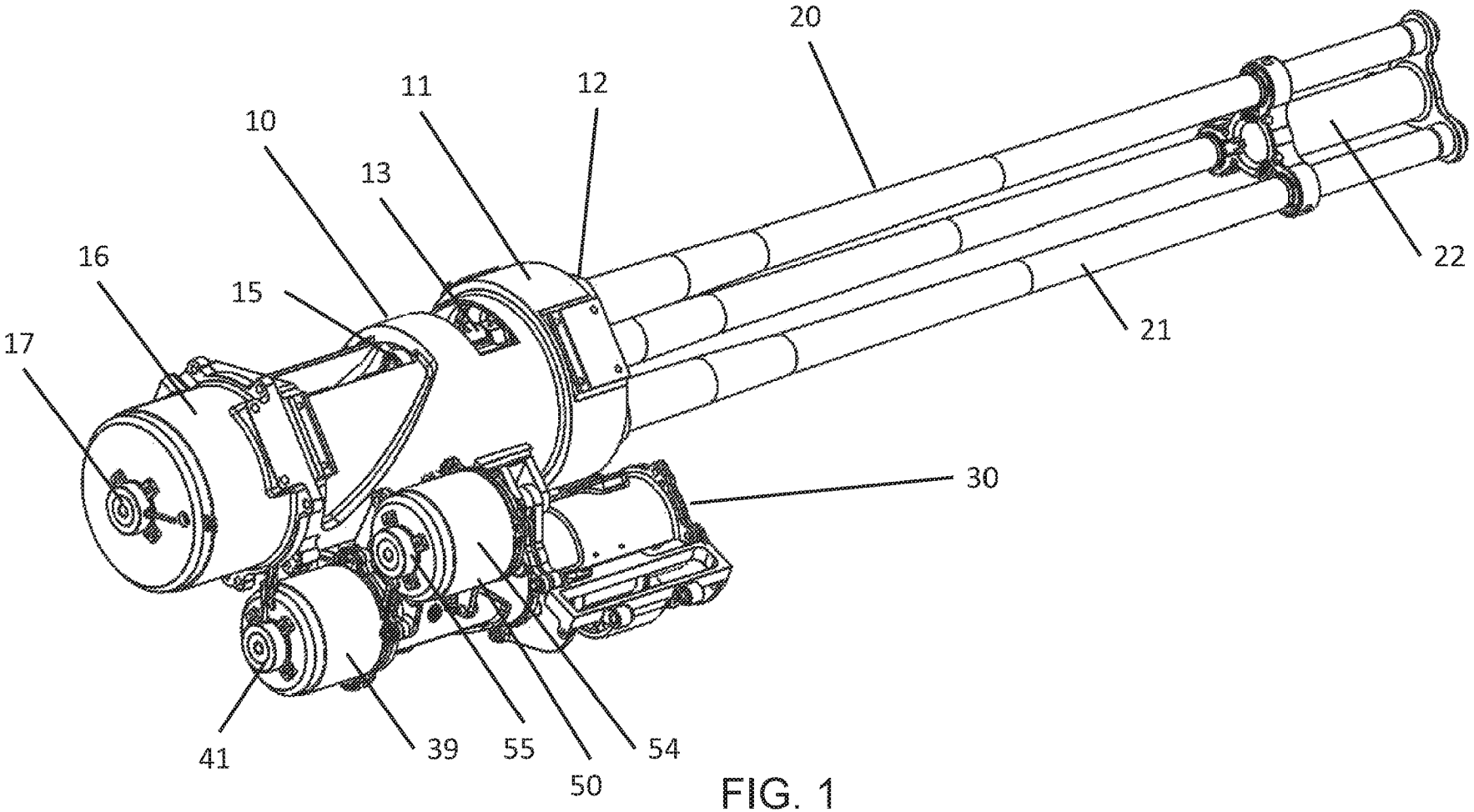
FIG. 1 is a rear perspective view of a an embodiment of an electrical drive motor system for a Gatling gun.
Figure 2:
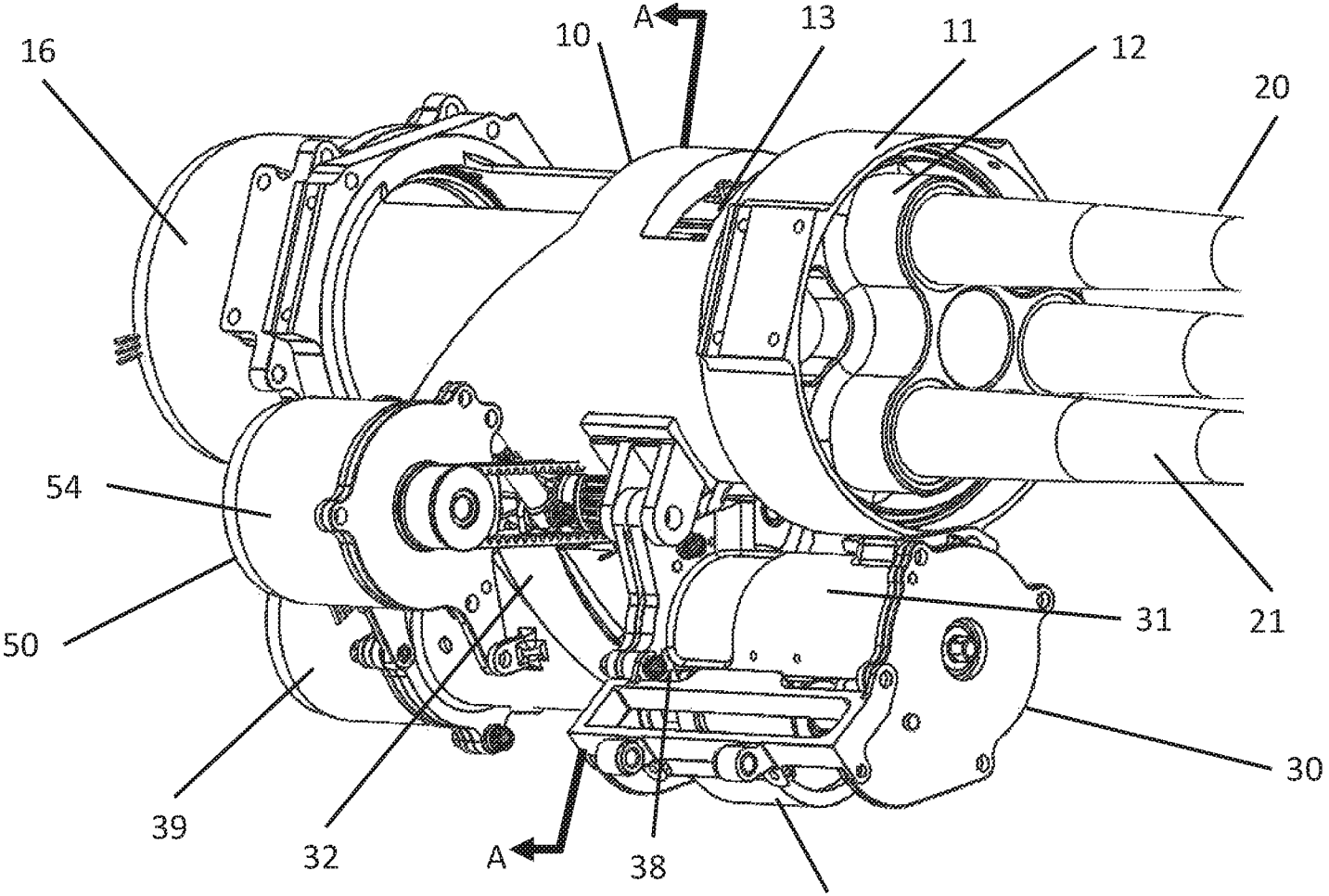
FIG. 2 is a front perspective view of the electrical drive motor system for a Gatling gun.
Figure 3:
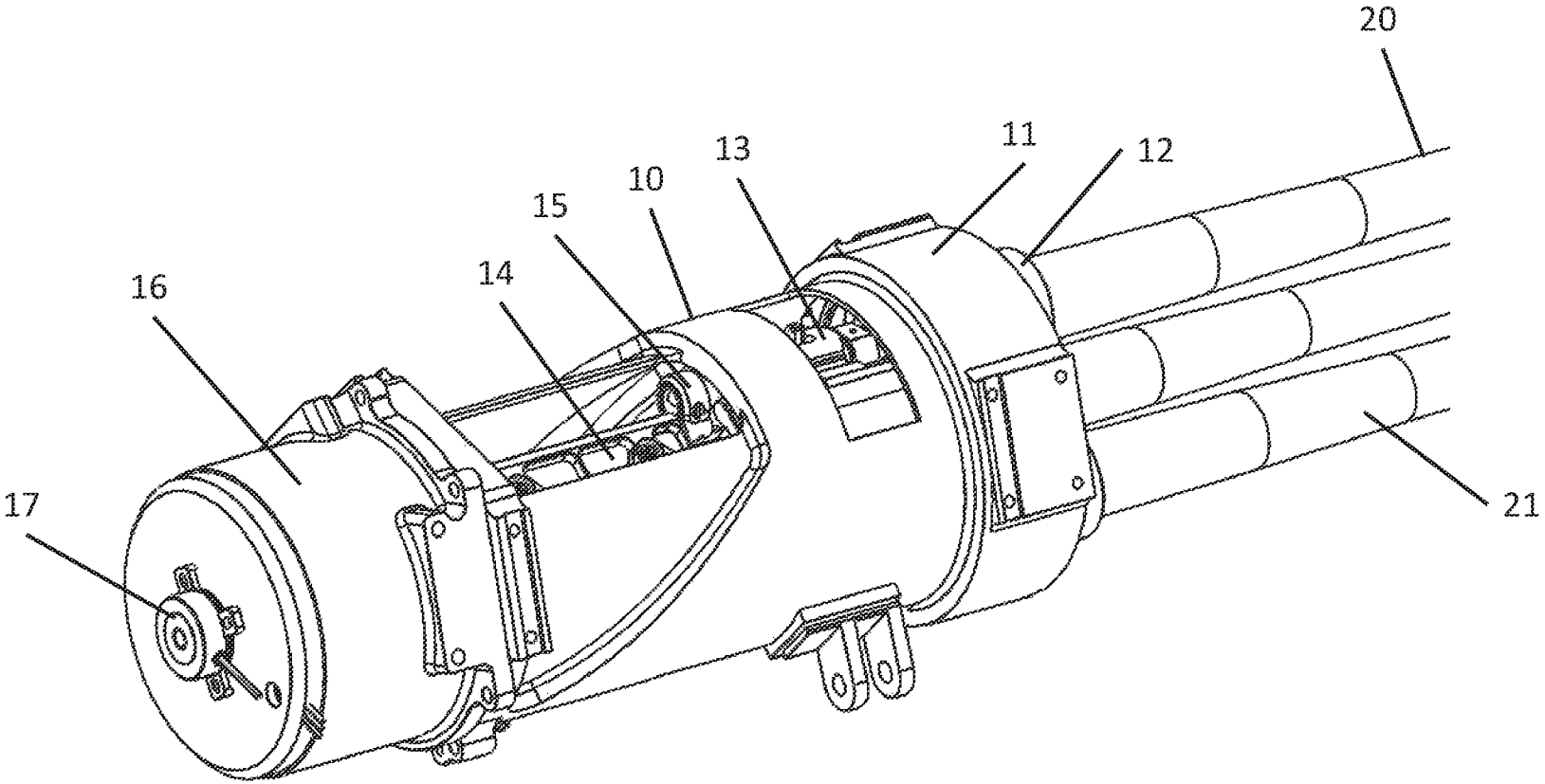
FIG. 3 is a rear perspective view of the electrical drive motor system a barrel assembly for a Gatling gun.
Figure 4:
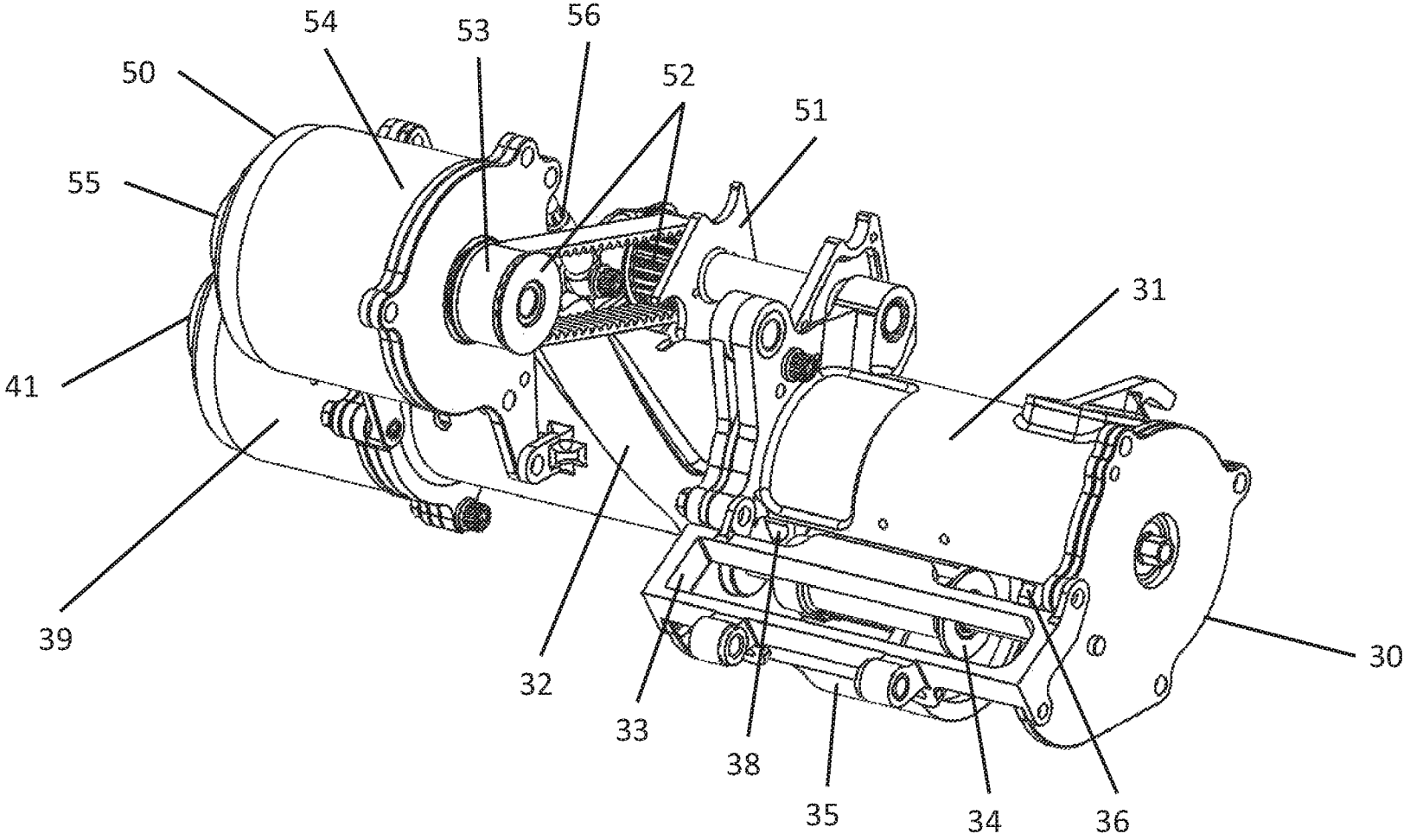
FIG. 4 is a front perspective view of an electrical drive motor system of an ammunition feed assembly and a transfer assembly for a Gatling gun.
Figure 5:
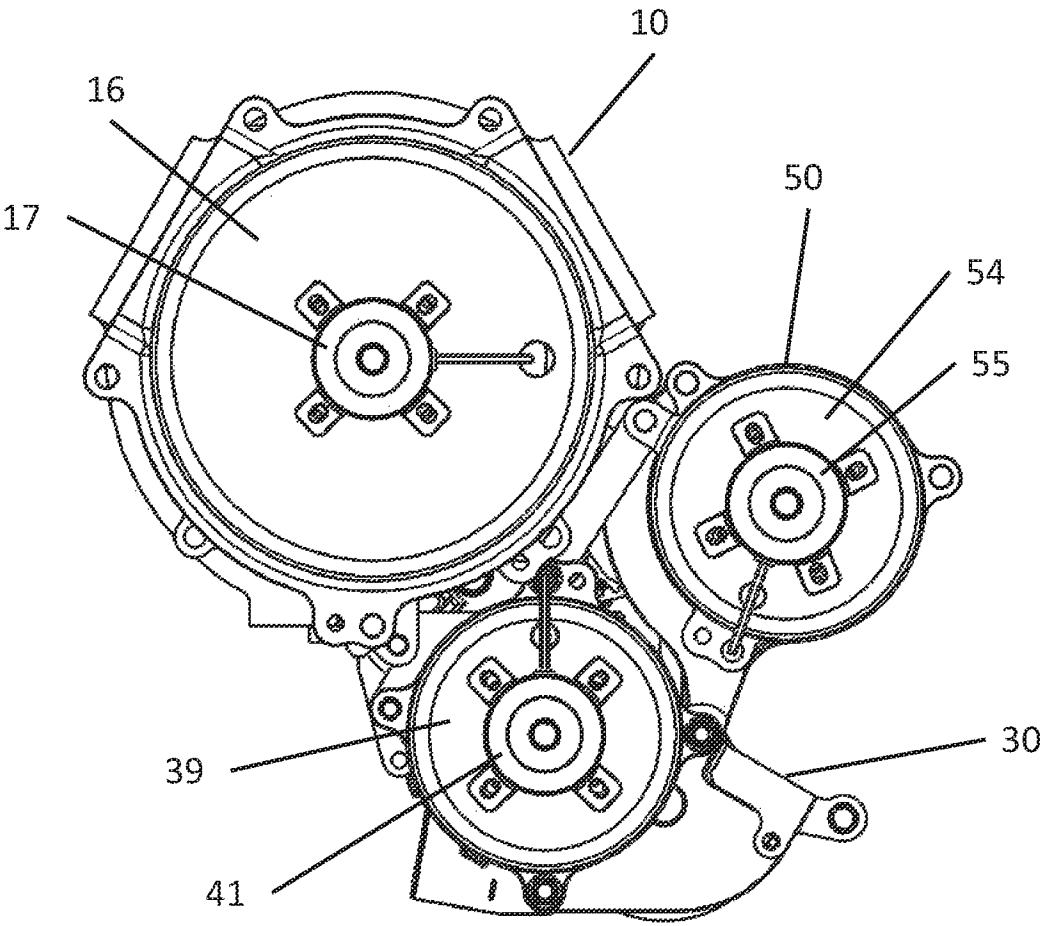
FIG. 5 is a rear elevation view of an electrical drive motor system for a Gatling gun.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, embodiments of the present invention provide an electrical motor drive system and method for firing a Gatling gun. As seen in reference to the drawings of FIGS. 1-5, a non-limiting embodiment of an electrical drive motor system for a Gatling gun is shown.

Aspects of the present invention eliminate or reduce the mechanical power transmission linkages between subsystems of the Gatling guy by the use of a plurality of independently controlled electronic drive motors, which minimize or eliminate the damage caused by mechanical linkages in gun stoppages. The independent electronic control of each electronic drive motor provides the functionality of the clearing cycle without mechanical complexity.

Advantages of the present invention over conventional designs include one or more of the following:

Reliability: Reduction in design part count will equate to an increase in overall system reliability. Each component has a failure risk and the more components that exist within a design, the more potential risk stacks up for overall system failure.

Occasionally in the field, the operators can assemble the subsystem components improperly synchronized and the handoff of ammunition can cause a gun stoppage. The independent control of each motor allows for automatic synchronization, the synchronization is one less thing the operator must maintain during assembly of the machine gun subsystems.

Durability: Disconnecting the mechanical power transmission between the subsystems can make a gun stoppage event less abusive to the internal components of the machine gun. The most common cause for gun stoppages in rotary type machine guns can be attributed in some way to the ammunition. In these type of gun stoppages, the ammunition becomes positioned improperly and impedes the rotation of that subsystem. Disconnecting the mechanical power transmission between subsystems will result in less energy being involved in any one stoppage event. There will be less rotational inertia involved to cause damages to internal components of the machine gun due to the stoppage.

Precision: Complex mechanical power transmission components often have some backlash or slop between components, and the more components stack up the more backlash can exist. The simplified power transmission for each subsystem through the use of independent electronic drive motors will allow greater precision by reducing the potential for position error due to backlash. The firing rate of the machine gun can be closely controlled to a desired rate with the precise position feedback from each subsystems motor. This allows for better accountability of ammunition fired, and the ability to adjust the firing rate to accommodate various mission uses of the machine gun.

A Gatling type machine gun according to aspects of the present invention includes a core gun assembly 10 and barrel cluster 20, a feeder assembly 30 (subsystem), and a transfer assembly 50 (subsystem). The core gun 10 includes a gun housing 11, a gun rotor 12, and a plurality of bolt assemblies 13. Rotation of the gun rotor 12 drives the motion of the bolt assemblies 13 via a helical shaped cam path within the gun housing 11 and rolling cam followers positioned atop each bolt assembly 13 and oriented radially perpendicular to the axis of rotation of the gun rotor 12.

The bolt assemblies 13 are guided in a relative fore and aft motion parallel to the axis of rotation by a rotor track 14 attached to the gun rotor 12. The bolt assemblies 13 are rotated to a locked position prior to firing by a bolt lock cam follower 15 that is positioned at a back end of each bolt assembly 13.

Rotation of the gun rotor 12 within the core gun 10 is provided by a directly coupled gun drive motor 16. The axis of rotation for the gun drive motor 16 is aligned with the axis of rotation of the gun rotor 12. Preferably, the gun motor position feedback sensor 17 is directly coupled and axially aligned with the gun motor 16 and gun rotor 12.

The barrel cluster 20 is comprised of a plurality of barrels 21, and a barrel clamp 22 at a distal end of the plurality of barrels 21. The individual barrels 21 are retained within the rotor 12 while the barrel clamp 22 keeps each barrel aligned during rotation.

The feeder assembly 30 subsystem is housed by a forward feeder housing 31, a feed cam housing 32, and a feeder inlet bracket 33. The rounds of ammunition enter the feeder 30 through the feeder inlet bracket 33 in a belted chain format. A feed roller 34 and the ammunition inlet guide 35 orient and position the ammunition prior to their engagement with the feed sprocket 36.

The feed sprocket 36 is axially aligned and directly connected in rotation to an extractor sprocket 37. Rotation of the extractor sprocket 37 drives the cartridge extractors 38 via a helical cam path within the feed cam housing 32 and rolling cam followers positioned atop each of the cartridge extractors 38 that are oriented radially perpendicular to the axis of rotation of the extractor sprocket 37. The cartridge extractors are guided in a relative fore and aft motion parallel to the axis of rotation of the feed sprocket 36 and the extractor sprocket 37. Each cartridge extractor 38 in turn pulls the ammunition cartridge rearward, removing it from the individual ammunition links that retain the ammunition rounds in the belt or chain of ammunition.

The rotation of the extractor sprocket 37 and feed sprocket 36 within the feeder 30 subsystem is provided by a directly coupled feeder drive motor 39. The axis of rotation for the feeder drive motor 39 is aligned with the axis of rotation of the feed sprocket 36 and extractor sprocket 37. Preferably, a feeder motor position feedback sensor 41 is directly coupled and axially aligned with the feeder drive motor 39, feed sprocket 36, and extractor sprocket 37.

The transfer assembly 50 subsystem is positioned directly between the core gun assembly 10 and the feeder assembly 30 subsystem to receive each individual cartridge of ammunition from the feeder assembly 30 subsystem and, in turn, transfer that ammunition round to the core gun assembly 10 at the specific instance and speed required for a smooth handoff. The transfer assembly 50 subsystem comprises a transfer sprocket 51, two timing pulleys 52, a timing belt 53, and a transfer drive motor 54, with a respective transfer drive motor position feedback sensor 55.

The transfer drive motor 54 is necessarily offset from the axis of rotation of the transfer sprocket 51 in order to satisfy geometric packaging constraints surrounding the transfer sprocket 51. The transfer drive motor 54 is directly coupled to one of the timing pulleys 52. The other timing pulley 52 is directly coupled to the transfer sprocket 51. In the embodiment shown, the timing pulleys 52 have the same number of teeth and therefore there is no gear ratio increase or decrease for the rotation of the transfer sprocket 51 in relation to the rotation of the transfer drive motor 54. The timing belt 53 is properly tensioned via a jack screw 56 to minimize any relative rotational slop between the transfer sprocket 51 and the transfer drive motor 54.

Figure 6:
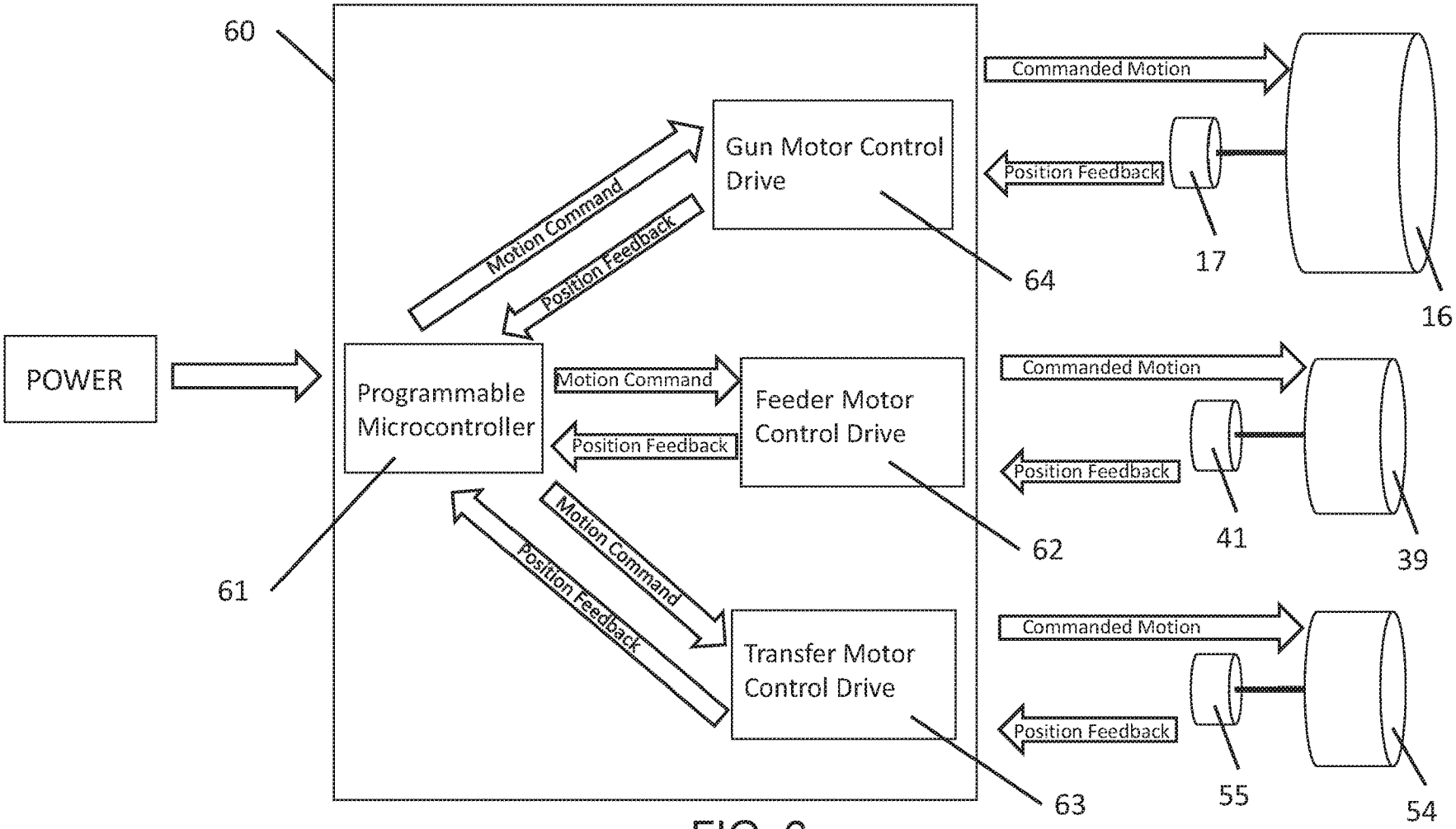
FIG. 6 is a schematic view of a drive motor controller for the electrical drive motor system.

An electronic controller 60 controls and synchronizes the operation of the gun rotor 12, the feeder drive motor 39, and the transfer motor 54. The electronic controller 60, shown in reference to FIG. 6 includes a programmable microcontroller 61, such as a Texas Instruments part number TMS320F2837xD, and an electric motor control drives 62, 63, and 64, for each motor 12, 39, 54. The electric motor control drives 62, 63, 64 may be any suitable control drive, such as a Copley part number GPM-055-60-R, that are specifically suited to provide commanded electrical signals to the gun drive motor 16 (Kollmorgen part number TBM12955B), the feed drive motor 39 (Kollmorgen part number TBM7646A), and the transfer drive motor 54 (Kollmorgen part number TBM7646A) electronic motors of a brushless DC, direct drive, frameless servo type.

The microcontroller 61 receives and interprets position information over 100 times per second, the position information provided by the three respective position feedback sensors, the gun motor position feedback sensor 17, the feeder motor position feedback sensor 41, and the transfer drive motor position feedback sensor 55 (Dynapar part number 15BRX-700-D10KC). If necessary, the microcontroller 61 adjusts a discrete motion command electrical signal that is sent to each drive motor 16, 39, and 54 to maintain proper operation and synchronization of the Gatling type machine gun.

Operation of a Gatling type machine gun requires that the position as well as the tangential velocity with respect to time of the ammunition round be matched at the moment of ammunition round handoff within the Gatling type machine gun to ensure proper function and smooth operation. The proper timing and handoff of ammunition throughout the weapon is accomplished largely from the function of the transfer sprocket 51.

To begin a firing sequence of the Gatling type machine gun, each drive motor 16, 39, and 54 is commanded to accelerate from a stationary initial condition. In the non-limiting embodiment described, control of the electronic controller 60 considers the feed drive motor 39 as the master, while the gun drive motor 16 and transfer drive motor 54 are slaved to accelerate relative to the feed drive motor 39 until a steady state velocity is achieved.

The electronic controller 60 provides a discrete motion command signal to each drive motor 16, 39, and 54 respectively, each discrete motion command signal has a trajectory profile. The trajectory profile of the gun drive motor 16 and the feed drive motor 39 are of a steady acceleration to reach a specified rotation rate, corresponding to an intended firing rate of the Gatling gun 10, at steady state. By way of example, with a specified rotation rate of 500 rpm and 300 rpm, for each of the gun drive motor 16 and the feed drive motor 39, respectively, an equivalent ammunition flow rate/firing rate of 1500 rounds of ammunition per minute is attained for a three barrel 21 Gatling gun 10.

The discrete motion command signal to the transfer motor 54, however, is provided a more complex motion trajectory profile to deliver the ammunition round at the correct time, position, and at a tangential velocity that is matched to the face of the bolt assembly 13 of the gun rotor 12. The transfer motor motion command signal has a trajectory profile that alternates between a lower threshold value and an upper threshold value, with a steady velocity shelf at the upper threshold during the transfer to the bolt assembly 13 at the transfer point.

Continuing with the previous example for a firing rate of 1500 rounds per minute, the lower threshold is 176 RPM and the upper threshold is 825 RPM. This trajectory profile ensures that the transfer sprocket 51 is receiving and providing ammunition round 70 at the correct time, position, and also matched tangential velocity at the moment of ammunition handoff. The motion trajectory profile for the transfer motor 54 is shown in FIG. 7 as a plot of the angular position, tangential velocity, and acceleration profiles for one cycle of ammunition handoff to achieve proper operation.

Figure 7:
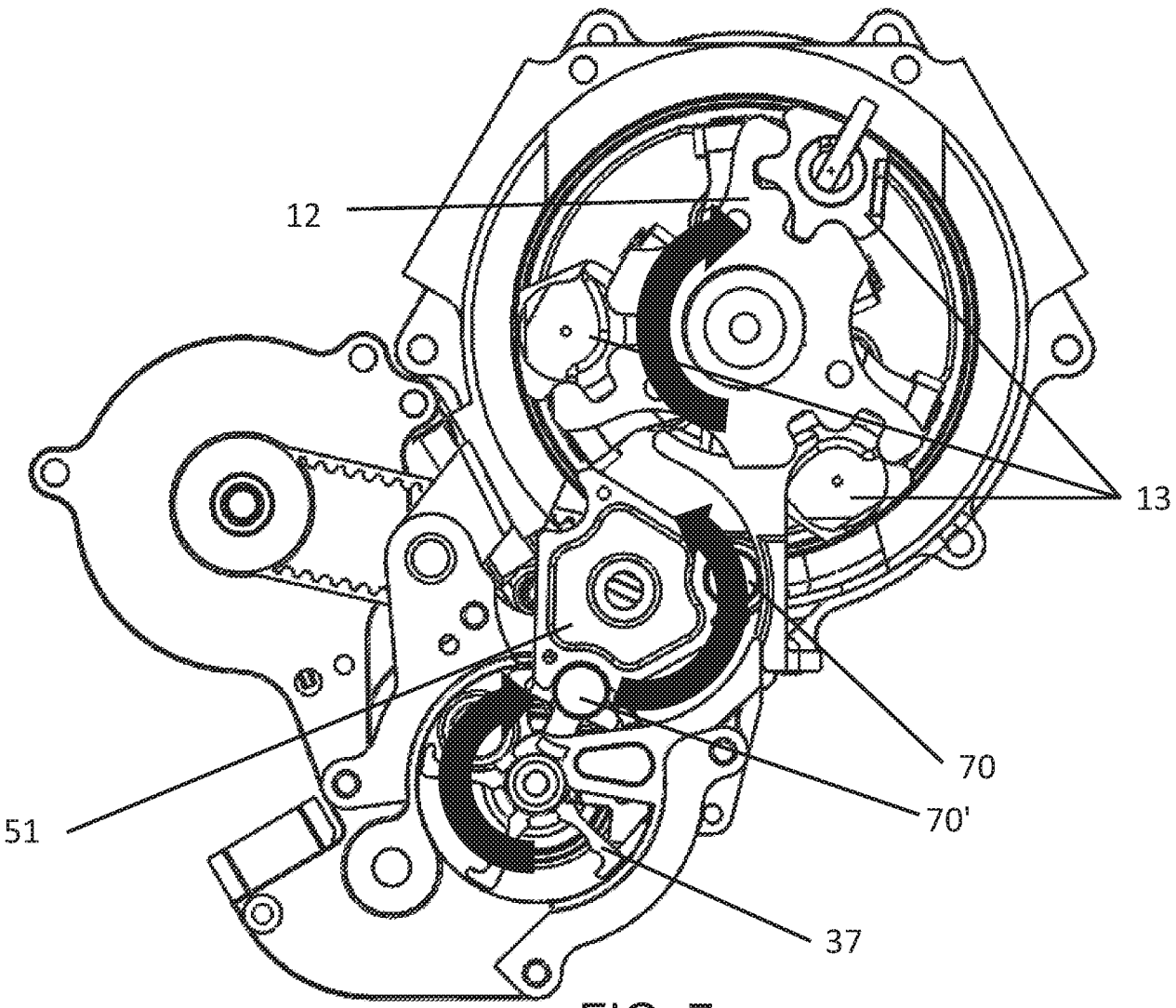
FIG. 7 is a front sectional view of the Gatling gun taken along line A-A of FIG. 2 showing an ammunition round pathway from the feeder assembly to the gun assembly.
Figure 9:
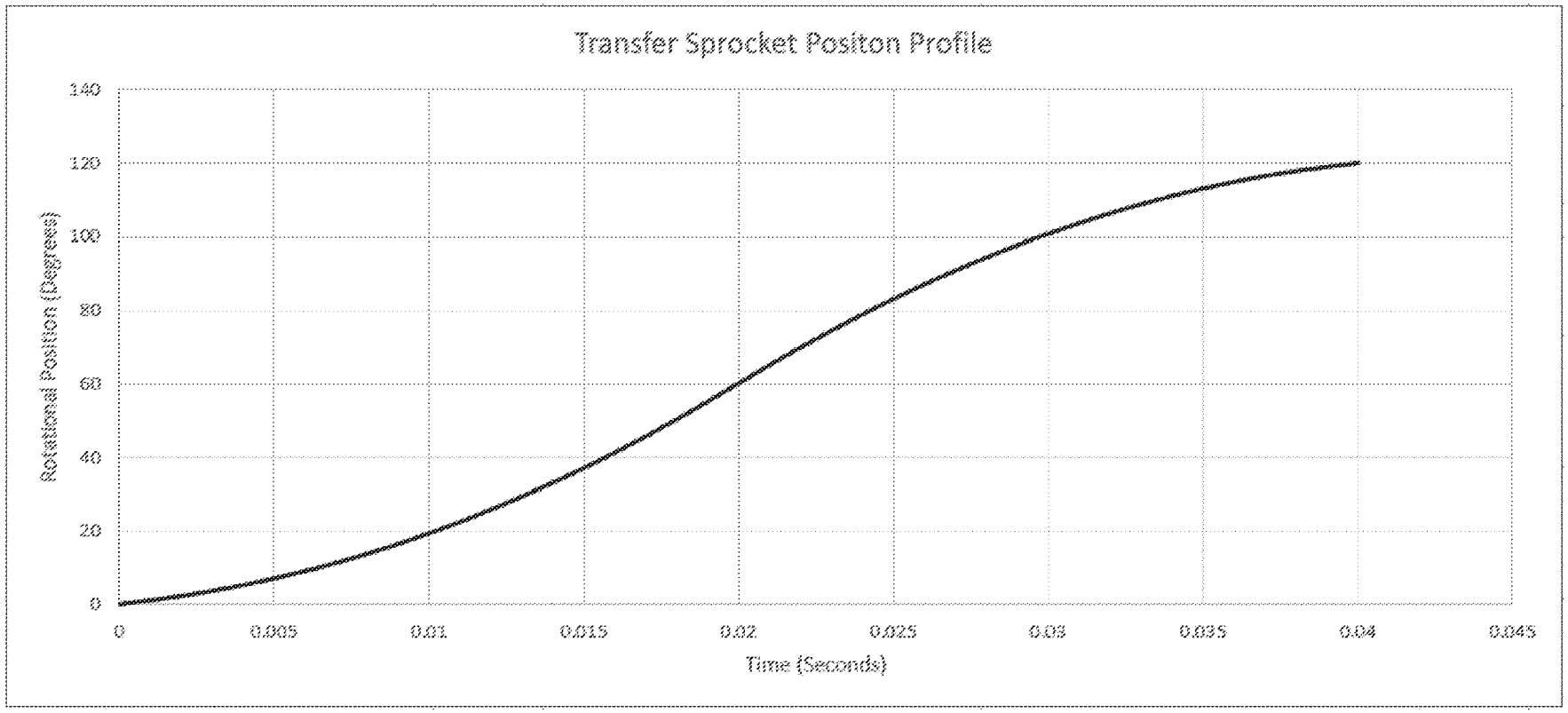
FIG. 9 is an angular displacement profile for a motion command signal to the transfer motor.
Figure 10:
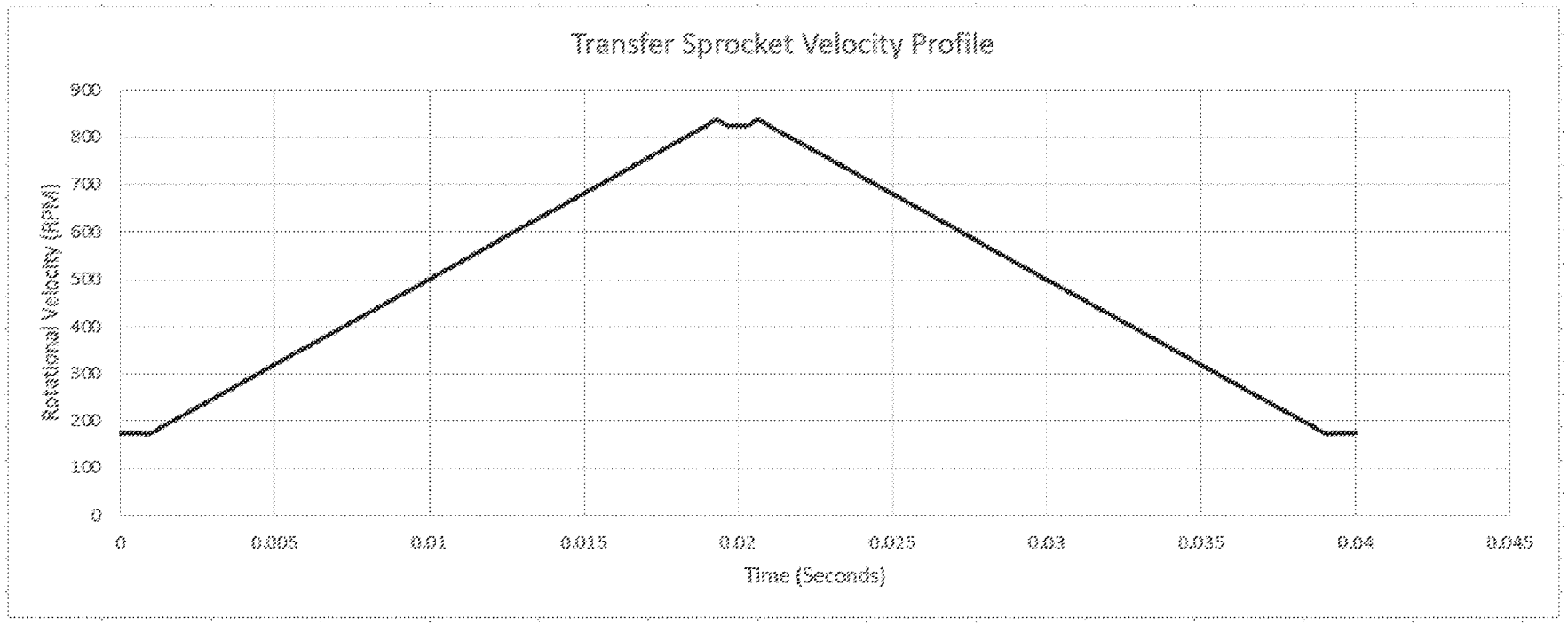
FIG. 10 is a rotational velocity profile for a motion command signal to the transfer motor.
Figure 11:
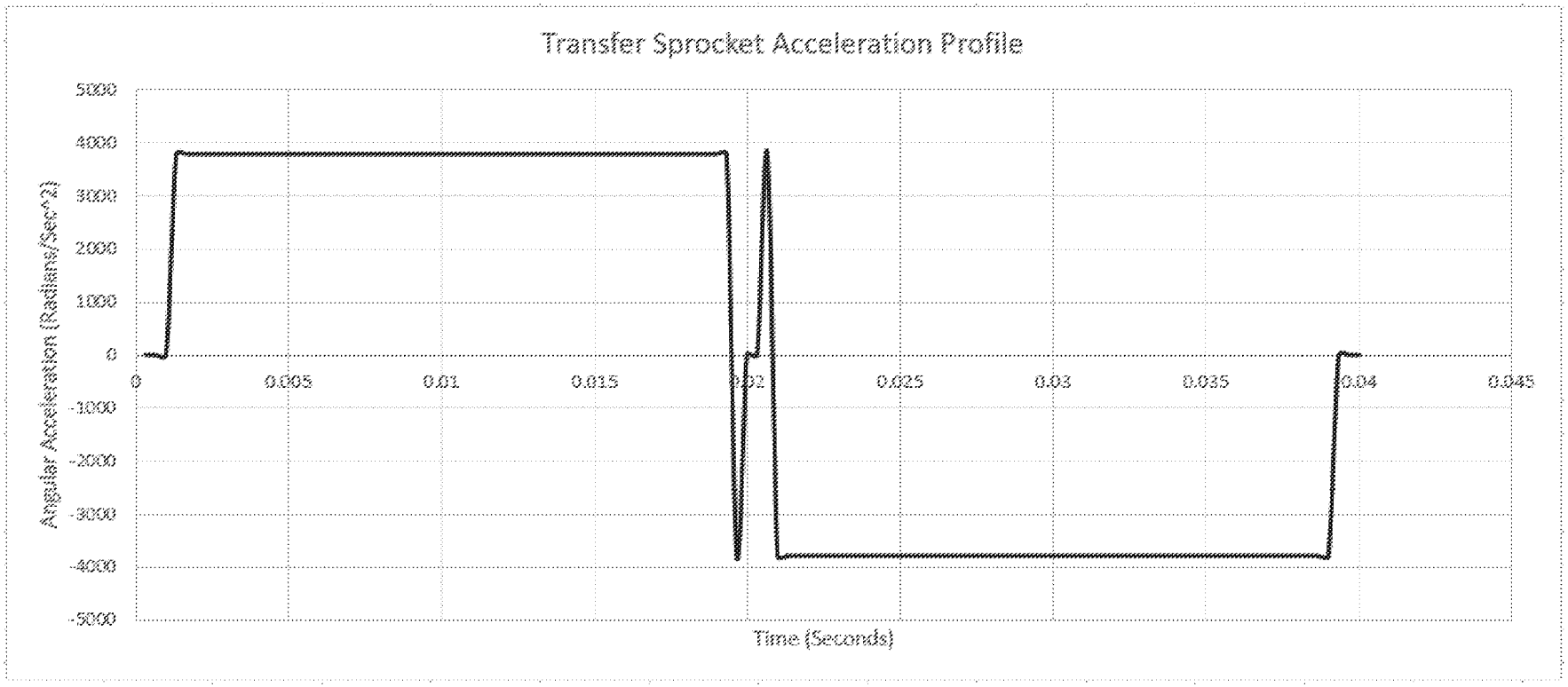
FIG. 11 is a rotational acceleration profile for a motion command signal to the transfer motor.

A detailed view of an ammunition round 70 progression through the Gatling gun is shown in reference to FIG. 7, in a cut away section viewed from the front showing the rotational directions and representing the relative locations of the ammunition cartridge 70 with respect to the extractor sprocket 37, the transfer sprocket transfer sprocket 51, and the gun rotor 12 at time 0.0 seconds of FIGS. 9, 10, and 11. At this time the ammunition cartridge 70 is being handed off from the extractor sprocket 37 to the transfer sprocket 51.

Figure 8:
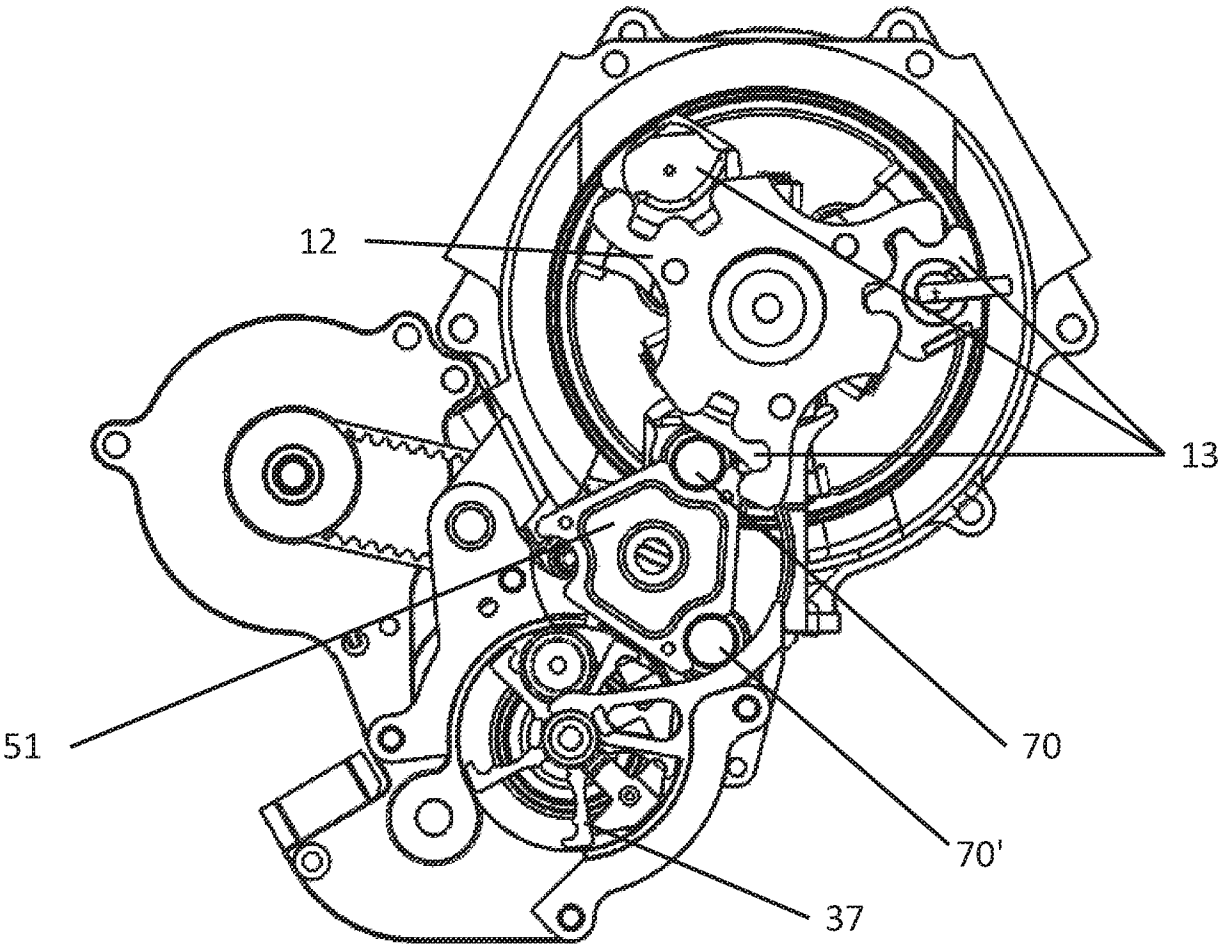
FIG. 8 is a front sectional view of the Gatling gun taken along line A-A of FIG. 2 showing an ammunition round transfer between the transfer sprocket of the transfer assembly and the bolt assembly of the gun assembly.

FIG. 8 represents the relative locations of the ammunition cartridge 70 with respect to the extractor sprocket 37, the transfer sprocket 51, and the gun rotor 12 at time 0.02 seconds on FIGS. 9, 10, and 11. At this time the ammunition cartridge 70 is being handed off from the transfer sprocket 51 to the gun rotor 12 and onto the face of bolt assembly 13. At this point the transfer sprocket 51 is at the upper threshold of the transfer motor velocity profile.

With the orientation of the feeder assembly 30 and transfer assembly 50 such as in the manner shown, the complexity of the ammunition round 70 pathway through the feeder assembly 30 and transfer assembly 50 to the barrel assembly 10 is greatly simplified. As indicated the pathway permits the ammunition round 70 to be readily transferred between the extractor sprocket 37 and the transfer sprocket 51 and the transfer sprocket and the bolt assembly 13. In the embodiment shown in FIG. 7, a first ammunition round 70 is carried by the transfer sprocket 51 while a subsequent ammunition round 70' is being received from the extractor sprocket 37. In FIG. 8, the first ammunition round 70 is handed off to the bolt assembly 13, while the subsequent ammunition round 70' is carried by the transfer sprocket 37.

The angular displacement diagram of FIG. 9 represents one iteration of a repetitive angular position profile with respect to time of the transfer sprocket 51 for an ammunition handoff cycle in a Gatling gun 10 with three barrels 21. The angular position of the transfer sprocket 51 at time 0.0 seconds for the ammunition cartridge 70 to be accepted from the extractor sprocket 37 is shown as 0 degrees. The angular position of the transfer sprocket 51 then increases to 60 degrees by time 0.02 seconds to provide the ammunition cartridge 70 to the gun rotor 12 and place it smoothly onto the face of the bolt assembly 13. The angular position of the transfer sprocket 51 then moves to 120 degrees by time 0.04 to receive another ammunition cartridge 70 from the extractor sprocket 37. The profile repeats every 120 degrees of rotation due to the presence of 3 ammunition pockets of the transfer sprocket 51.

FIG. 10 represents one iteration of the repetitive angular velocity profile with respect to time of the transfer sprocket 51 for an ammunition handoff cycle. The RPM values for the transfer sprocket 51 at time 0.0 and 0.02 seconds indicate that the tangential velocity of each component that is carrying and receiving an ammunition cartridge 70 will match at moments of ammunition handoff for a smooth operation. The RPM of the transfer sprocket 51 at time 0.0 seconds for the ammunition cartridge 70 to be accepted from the extractor sprocket 37 is shown as 176 RPM. The RPM of the transfer sprocket 51 then ramps up to 825 RPM by time 0.02 seconds to provide the ammunition cartridge 70 to the gun rotor 12 and place it smoothly onto the face of the bolt assembly 13.

The RPM of the transfer sprocket 51 then slows down to return to 176 RPM by time 0.04 to receive another ammunition cartridge 70 from the extractor sprocket 37 and then repeats the cycle. The mathematical representation of the angular velocity profile ramp of the transfer sprocket 51 can be described using the equation $y=mx+b$. Where "y" is the angular velocity of the transfer sprocket 51, "m" is the slope of the angular velocity ramp, "x" is the time, and "b" is the y intercept of the angular velocity ramp trend line. In this case, "m", and in other words known as rise over run, is the difference between the upper and lower limits of RPM for the transfer sprocket 51 divided by the time required. Numerically $m=(825-176)$ RPM/0.018 seconds, and the value of "b" is 176 RPM as the initial condition for the start of the angular velocity ramp.

FIG. 11 represents the angular acceleration profile of the transfer sprocket 51 required to achieve the increase and decrease of RPMs of the transfer sprocket 51 and the prescribed times. The angular acceleration profile of the transfer sprocket 51 can be mathematically described as the first derivative of the angular velocity profile with respect to time using the equation y=dx/dt, where "y" is the angular acceleration value at a given time, "dx" is the instantaneous change is angular velocity, and "dt" is the instantaneous change in time. The angular acceleration value for the start of the angular velocity ramp of the transfer sprocket 51 is 3781 radians/second ^2.

It should be understood, of course, that the foregoing relates to exemplary embodiments of the invention and that modifications may be made without departing from the spirit and scope of the invention as set forth in the following claims.

What is claimed is:

1. A revolving battery machine gun, comprising:

a core gun assembly including a barrel cluster having a plurality of radially disposed gun barrels rotationally carried by a gun rotor, a bolt assembly configured to chamber and extract an ammunition round into each of the plurality of radially disposed gun barrels, and a gun motor coupled for axial rotation of the gun rotor;

a feeder assembly having a feed sprocket configured to individually draw a plurality of ammunition rounds from a source of ammunition, an extractor sprocket rotationally carried with the feed sprocket, and a feeder motor coupled for axial rotation of the feed sprocket and the extractor sprocket;

a transfer assembly having a transfer sprocket configured to transfer each of the plurality of ammunition rounds between the feeder assembly and the bolt assembly, and a transfer motor coupled for axial rotation of the transfer sprocket; and an electronic controller that provides a discrete motion command signal to each of the gun motor, the feeder motor, and the transfer motor, wherein the discrete motion command signal has a trajectory profile corresponding to a desired rate of fire.

2. The revolving battery machine gun of claim 1, the electronic controller further comprising:

a programmable micro controller in communication with a gun motor control drive operatively coupled to deliver a gun drive motion command signal to the gun motor.

3. The revolving battery machine gun of claim 2, further comprising:

a feeder motor control drive in communication with the programmable micro controller and operatively coupled to deliver a feeder motion command signal to the feeder motor.

4. The revolving battery machine gun of claim 3, further comprising:

a transfer motor control drive in communication with the programmable micro controller and operatively coupled to deliver a transfer motion command signal to the transfer motor.

5. The revolving battery machine gun of claim 4, wherein the transfer motion command signal comprises:

a trajectory profile that alternates between a lower threshold value and an upper threshold value, and a steady velocity shelf at the upper threshold value at transfer point for a transfer of an ammunition round between the transfer sprocket and the bolt assembly.

6. The revolving battery machine gun of claim 2, wherein the gun drive motion command signal comprises:

a steady acceleration to reach a specified rotation rate of the gun motor.

7. The revolving battery machine gun of claim 3, wherein the feeder motion command signal comprises:

a steady acceleration to reach a specified rotation rate of the feeder motor.

8. An electronic drive system for a revolving battery machine gun, comprising:

an electronic gun motor coupled for axial rotation of a rotor of a gun barrel assembly;

an electronic feeder motor coupled for axial rotation of a feed sprocket configured to draw a plurality of ammunition rounds from a source of ammunition;

an electronic transfer motor coupled for axial rotation of a transfer sprocket configured to transfer each of the plurality of ammunition rounds between a feeder assembly and a breach assembly; and an electronic controller that provides a discrete motion command signal to each of the electronic gun motor, the electronic feeder motor, and the electronic transfer motor, wherein each said discrete motion command signal has a trajectory profile corresponding to a desired rate of fire.

9. The electronic drive system of claim 8, wherein an output shaft of the electronic gun motor is directly coupled to the rotor.

10. The electronic drive system of claim 9, wherein the output shaft of the electronic gun motor is coaxially aligned with an axis of rotation of the rotor.

11. The electronic drive system of claim 8, wherein an output shaft of the electronic feeder motor is directly coupled to the feed sprocket.

12. The electronic drive system of claim 11, wherein the output shaft of the electronic feeder motor is coaxially aligned with an axis of rotation of the feed sprocket.

13. The electronic drive system of claim 8, further comprising:

a first pulley coupled to an output shaft of the electronic transfer motor;

a second pulley coupled for axial rotation of the transfer sprocket; and a drive belt entrained about the first pulley and the second pulley.

14. The electronic drive system of claim 13, wherein the output shaft of the electronic transfer motor is coaxially aligned with a rotational axis of the first pulley.

15. The electronic drive system of claim 8, the electronic controller further comprising:

a gun motor control drive interposed between a programmable micro controller and the electronic gun motor;

a feeder motor control drive interposed between the programmable micro controller and the electronic feeder motor; and a transfer motor control drive interposed between the programmable micro controller and the electronic transfer motor.

16. The electronic drive system of claim 15, further comprising:

a gun motor position feedback sensor in communication with the gun motor control drive, the gun motor position feedback sensor configured to detect an angular displacement of the electronic gun motor;

a feeder motor position feedback sensor in communication with the feeder motor control drive, the feeder motor position feedback sensor configured to detect an angular displacement of the electronic feeder motor; and a transfer motor position feedback sensor in communication with the transfer motor control drive, the transfer motor position feedback sensor configured to detect an angular displacement of the electronic transfer motor.

17. The electronic drive system of claim 16, wherein the programmable micro controller synchronizes propagation of the discrete motion command signal to each of the gun motor control drive, the feeder motor control drive, and the transfer motor control drive.

18. The electronic drive system of claim 17, wherein the programmable micro controller slaves propagation of a gun trajectory profile and a transfer trajectory profile to a feeder trajectory profile.

19. An electronic transfer assembly for a revolving battery machine gun, comprising:

a transfer sprocket rotatable to receive an ammunition round from an extractor sprocket of a feeder assembly to a bolt assembly of the revolving battery machine gun;

an electronic transfer motor coupled to rotate the transfer sprocket; and a programmable micro controller programmed to send a motion command signal to the electronic transfer motor, the motion command signal having a transfer trajectory profile that alternates between a lower threshold value and an upper threshold value, wherein the lower threshold value corresponds to an ammunition round transition between the extractor sprocket and the transfer sprocket and the upper threshold value corresponds to an ammunition round transition between the transfer sprocket and the bolt assembly.

20. The electronic transfer assembly of claim 19, the transfer trajectory profile further comprising:

a steady velocity shelf defined in at the upper threshold value at a transfer of the ammunition round between the transfer sprocket and the bolt assembly.

* * * * *